United States Patent [19]

Kobayashi et al.

[11] Patent Number: 4,592,856

[45] Date of Patent: Jun. 3, 1986

[54] LIQUID DETERGENT COMPOSITION

[75] Inventors: Taishi Kobayashi; Shinichiro Akase, both of Joetsu, Japan

[73] Assignee: Shin-Etsu Chemical Co., Ltd., Tokyo, Japan

[21] Appl. No.: 667,537

[22] Filed: Nov. 2, 1984

[30] Foreign Application Priority Data

Nov. 14, 1983 [JP] Japan ..... 58-213476
Apr. 9, 1984 [JP] Japan ..... 59-70551

[51] Int. Cl.[4] ..... C11D 7/22

[52] U.S. Cl. ..... 252/162; 134/38; 252/153; 252/167; 252/547

[58] Field of Search ..... 252/DIG. 10, 162, 153, 252/167, 170, 171, 172, 547; 134/38, 40

[56] References Cited

U.S. PATENT DOCUMENTS

| | | | |
|---|---|---|---|
| 3,723,330 | 3/1973 | Sheflin | 252/DIG. 10 |
| 3,822,213 | 7/1974 | Johnson | 252/162 |
| 3,856,695 | 12/1974 | Geiss et al. | 252/DIG. 10 |
| 3,915,902 | 10/1975 | Ancel et al. | 252/162 |
| 4,086,178 | 4/1978 | Walker | 252/DIG. 11 |
| 4,097,397 | 6/1978 | Mizutani et al. | 252/545 |
| 4,100,093 | 7/1978 | Rialdi | 252/167 |
| 4,213,873 | 7/1980 | Church | 252/162 |
| 4,267,077 | 5/1981 | Niimi et al. | 252/547 |
| 4,409,116 | 10/1983 | Lodico | 252/162 |

*Primary Examiner*—Paul Lieberman
*Assistant Examiner*—Willie J. Thompson
*Attorney, Agent, or Firm*—Toren, McGeady, Stanger, Goldberg & Kiel

[57] ABSTRACT

The liquid detergent composition of the invention comprises a halogenated hydrocarbon solvent, e.g. methylene chloride, an anionic and/or non-ionic surface active agents, a quaternary ammonium hydroxide, e.g. tetramethyl ammonium hydroxide and choline, and, optionally, a lower aliphatic alcohol, e.g. methyl alcohol, each in a limited proportion. The detergent composition is very effective in the cleaning works of articles of a transparent plastic resin, e.g. polycarbonate resin, and metal or glass molds for the preparation of such resin articles by casting polymerization, of which uppermost cleanness on the surface is very essential in respect of oily, greasy and resinous contaminants.

7 Claims, No Drawings

LIQUID DETERGENT COMPOSITION

BACKGROUND OF THE INVENTION

The present invention relates to a liquid detergent composition or, more particularly, to a liquid detergent composition comprising a halogenated hydrocarbon solvent as the principal component suitable for cleaning the surface of various articles stained with oily, greasy or resinous contaminants.

Needless to say, several shaped articles of plastics are required to have extremely high cleanness on the surface in view of their use including, for example, plastic-made eye glasses and lenses in various optical instruments usually shaped by the method of casting polymerization of polycarbonate resins, poly(methyl methacrylate) resins, diethyleneglycol bisallylcarbonate resins and the like transparent plastics. These plastic-made articles as shaped are usually not free from contamination or stain on the surface, for example, with smears or fragment pieces of the plastic or perspiration and other excretions from the skin of the workers as in fingerprints as well as dirty matters coming from the working gloves. Accordingly, it is usual that the surfaces of these plastic articles are thoroughly cleaned using a detergent composition before they are packaged and shipped as commercial products.

In addition, although the requirement for the surface cleanness is not so rigorous as in the above mentioned plastic articles for optical uses, it is of course desirable for any articles shaped with the above mentioned resins that the surface should be fairly clean from the standpoint of commercial value of these transparent plastic articles while it is a rather difficult problem because the metal or glass molds used for the casting polymerization of these resins usually cannot be clean enough so that the plastic articles shaped with such an unclean mold are also not acceptable in respect of the surface cleanness. Therefore, it is essential that the metal or glass mold used for the casting polymerization of the above mentioned resins is thoroughly cleaned using a detergent composition after each time of the casting polymerization runs to prepare for the next use to be freed from any contaminants and dirty matters including plastic debris or fragment, greases, fingerprints and the like.

As a consequence of the nature of the stain or contaminant on the surface of the above mentioned plastic articles or molds used for the preparation thereof, which is usually oily, greasy or resinous, it is a common practice that an organic solvent is used as a detergent for the cleaning works in the above mentioned cases. For example, various kinds of halogenated hydrocarbon solvents, such as methylene chloride, 1,1,1-trichloroethane, trichloroethylene, tetrachloroethylene and the like, are widely used for the purpose by virtue of their high detergent power along with the non-inflammability. Methylene chloride is particularly preferred due to its relatively low toxicity to the human body. These organic solvents, however, are not quite powerful as a detergent for the cleaning works in the above mentioned cases so that complete cleaning is hardly possible even by a prolonged washing with the solvent. Therefore, it is a usual practice that cleaning of the stain or contaminant with these halogenated hydrocarbon solvents is followed by manual wiping works of the surface with a cloth wet with acetone, alcohol or other solvent resulting in a great decrease in the productivity of the overall production process.

Accordingly, it is eagerly desired to develop a detergent composition with which a high efficiency is obtained in the cleaning works of the plastic-made articles and the molds for the preparation thereof.

SUMMARY OF THE INVENTION

It is therefore an object of the present invention to provide a novel and improved liquid detergent composition with which a very high efficiency is obtained in the cleaning works of the surfaces of shaped articles made of the above mentioned plastic resins as well as metal or glass molds used for the preparation thereof.

Another object of the invention is to provide a liquid detergent composition comprising, as the principal component, a halogenated hydrocarbon solvent and usable in the above mentioned cleaning works without the necessity of following manual wiping with a cloth wet with another organic solvent to clean up the surface.

Thus, the liquid detergent composition of the invention comprises:

(a) a halogenated hydrocarbon solvent as the base component; and (b) a surface active agent selected from the group consisting of anionic and non-ionic surface active agents in an amount from 0.01 to 10% by weight of the detergent composition.

Further, it is preferable that the liquid detergent composition additionally comprises from 0.001 to 20% by weight of a quaternary ammonium hydroxide.

Still further, it is also preferable that the inventive liquid detergent composition additionally comprises from 1 to 20% by weight of a monohydric aliphatic saturated alcohol having 6 or smaller number of carbon atoms in a molecule.

DETAILED DESCRIPTION OF THE PREFERRED EMBODIMENTS

As is understood from the above description, the principal component of the inventive liquid detergent composition is a halogenated hydrocarbon solvent which is admixed with one or more of the above mentioned additives to form the inventive liquid composition. The halogenated hydrocarbon solvent suitable in the inventive liquid composition is exemplified by methylene chloride, 1,1,1-trichloroethane, trichloroethylene, tetrachloroethylene and the like, of which methylene chloride is particularly preferred by virtue of the excellent cleaning power and low toxicity as well as the non-inflammability to ensure high efficiency and safety in the cleaning works.

The essential additive in the inventive liquid detergent composition based on the above defined halogenated hydrocarbon solvent is a surface active agent which can be either anionic or non-ionic. A combination of these two types of surface active agents can be used or is rather preferable in some cases. Suitable anionic surface active agents include, for example, salts of alkylsulfate esters, salts of alkylbenzene sulfonates, salts of alkylsulfosuccinates, salts of alkylphosphate esters, salts of polyoxyethylene alkyl phenyl ether sulfates and the like and suitable non-ionic surface active agents include polyoxyethylene alkyl ethers, polyoxyethylene alkyl phenyl ethers and the like. The amount of the anionic and/or non-ionic surface active agents in the inventive liquid detergent composition should be in the range from 0.01 to 10% by weight or, preferably, from 0.1 to 5% by weight of the composition, the balance being the halogenated hydrocarbon solvent and other optional additives, if any.

In addition to the above described anionic and/or non-ionic surface active agents as an essential additive, the inventive liquid detergent composition may preferably contain a quaternary ammonium hydroxide such as tetramethyl ammonium hydroxide, tetraethyl ammonium hydroxide, choline, trimethyl benzyl ammonium hydroxide and the like whereby the detergent power of the inventive composition can be further increased. The amount of the quaternary ammonim hydroxide should be in the range from 0.001 to 20% by weight of the composition, the balance being the halogenated hydrocarbon solvent, the anionic and/or non-ionic surface active agents and other optional additives.

Although the content of the quaternary ammonium hydroxide in the inventive liquid detergent composition should be, as is grossly given in the above, in the range from 0.001 to 20% by weight, the exact amount thereof should be selected according to the intended application of the detergent composition. When the intended application of the composition is for the cleaning works of plastic-made shaped articles per se, for example, the preferable amount of the quaternary ammonium hydroxide is relatively small, for example, in the range from 0.001 to 0.2% by weight or, more preferably, from 0.01 to 0.1% by weight. This is because a large amount of addition of the quaternary ammonium hydroxide increases the dissolving power of the composition to a resinous material so that, in addition to the oily or greasy stain or contaminants, the surface of the plastic-made shaped article per se may be attacked by the detergent composition to cause decrease in the beautiful appearance of the article.

When the intended application of the inventive liquid detergent composition is for the cleaning works of, for example, metal or glass mold used for the preparation of plastic articles, on the other hand, it is of course desirable that any trace amount of the resinous contaminant should be dissolved away as completely as possible so that the detergent composition should have a full power of dissolving resinous materials. In this regard, the amount of the quaternary ammonium hydroxide should be relatively high within the upper limit of 20% by weight. Accordingly, the preferable amount of the quaternary ammonium hydroxide in the detergent composition for such an application is in the range from 0.1 to 20% by weight or, more preferably, from 0.2 to 2% by weight in view of the balance of the detergent power and the cost due to the increased content of the relatively expensive quaternary ammonium hydroxide.

A further optional aditive component in the inventive liquid detergent composition is a monohydric aliphatic saturated alcohol having 6 or smaller number of carbon atoms in a molecule exemplified by methyl, ethyl, isopropyl, n-butyl and hexyl alcohols, of which methyl alcohol is particularly preferred. The addition of these alcohols is effective to increase the detergency of the composition to the contaminants having polar nature such as the perspiration and other excretions, e.g. proteins, originating in the worker's body. The amount of the alcohol as the additive should be in the range from 1 to 20% by weight or, preferably, from 2 to 20% by weight of the composition.

In addition to the above described additives directly pertaining to the detergent power of the inventive liquid composition, it is of course optional that the inventive liquid detergent composition contains limited amounts of one or more of other additives having no direct influence on the detergent power of the composition such as a stabilizer of the halogenated hydrocarbon solvent exemplified by epoxides such as propylene oxid, butylene oxide and the like, amine compounds such as diisopropylamine, isopropylamine and the like and nitroalkane compounds such as nitromethane, nitroethane and the like.

The inventive liquid detergent composition can be obtained by merely blending the above described components in the respectively specified proportions and dissolving or dispersing the additive components in the halogenated hydrocarbon solvent. When a relatively large amount of the quaternary ammonium hydroxide is used, however, it is preferable that the quaternary ammonium hydroxide is first dissolved in a small volume of water or a lower alcohol such as methyl and ethyl alcohols and the aqueous or alcoholic solution is added to the composition. In the case of using an aqueous of alcoholic solution of the quaternary ammonium hydroxide, the amount of water or alcohol as the solvent thereof should be limited. For example, the overall amount of the water and alcohol should not exceed 20% by weight or, preferably, 10% by weight of the composition. Due to the immiscibility of water with the halogenated hydrocarbon solvent as the base component of the composition, the resultant liquid detergent composition may be a binary-phase composition which may be separated on standing into organic and aqueous layers, the former being the upper layer and the latter being the lower layer. The detergent power of the inventive liquid detergent composition is, however, not affected even when the composition is separated into two layers as mentioned above. Moreover, to the contrary, an advantage is obtained with such a binary-phase composition that the evaporation loss of the highly vaporizable methylene chloride or other halogenated hydrocarbon solvent can be minimized in storage because the surface of the composition in standing is covered with the separated aqueous layer.

As is understood from the above description, the inventive liquid detergent composition can be imparted with a controlled detergent power according to the nature of the contaminant to be cleaned in respect of the solubility or polarity by suitably selecting the amounts of the additive components so that the troublesome process of manual wiping of the articles after cleaning with the liquid detergent composition can be omitted greatly contributing to the improvement of the productivity of plastic-made articles and other goods in which surface cleanness is essential.

In the following, the formulation and effectiveness of the inventive liquid detergent compositions are described in more detail by way of examples.

EXAMPLE 1

Plastic lenses for eyeglasses were prepared by the method of casting polymerization of a polymerizable mixture composed of 96% by weight of diethyleneglycol bisallylcarbonate resin and 4% by weight of diisopropylperoxy dicarbonate in a glass mold and 100 pieces of the lenses, each of which was contaminated on the surface with smears of the starting resin, fingerprints and patterns of the working gloves, were put into a cleaning basket and subjected to the cleaning procedure as follows.

The cleaning procedure was composed of the repeated dipping steps each for 1 minute in the bath as shown below.

(1) Two organic solvent-based detergent baths each under ultrasonic waves and containing the liquid detergent composition prepared according to one of the formulations No. 1 to No. 21 indicated in Table 1 below.

TABLE 1

| Experiment No. | Formulation of detergent composition, % by weight | | | | | | | | % of acceptably cleaned lenses |
|---|---|---|---|---|---|---|---|---|---|
| | $CH_2Cl_2$ | $CCl_2$=CHCl | POEN | DBS-Na | TMAH (1) | CHOL (1) | MeOH | i-PrOH | |
| 1 | 98.0 | — | 2.0 | — | — | — | — | — | 85 |
| 2 | 98.0 | — | — | 2.0 | — | — | — | — | 82 |
| 3 | 98.0 | — | 1.0 | 1.0 | — | — | — | — | 90 |
| 4 | 93.0 | — | 2.0 | — | 5.0 | — | — | — | 93 |
| 5 | 93.0 | — | 2.0 | — | 5.0 | — | — | — | 94 |
| 6 | 93.0 | — | — | 2.0 | 5.0 | — | — | — | 92 |
| 7 | 93.0 | — | 1.0 | 1.0 | 5.0 | — | — | — | 97 |
| 8 | 93.0 | — | 2.0 | — | — | — | 5.0 | — | 88 |
| 9 | 93.0 | — | — | 2.0 | — | — | 5.0 | — | 86 |
| 10 | 93.0 | — | 1.0 | 1.0 | — | — | 5.0 | — | 92 |
| 11 | 88.0 | — | 2.0 | — | 5.0 | — | 5.0 | — | 94 |
| 12 | 88.0 | — | 1.0 | 1.0 | 5.0 | — | 5.0 | — | 98 |
| 13 | 93.0 | — | 2.0 | — | — | 5.0 | — | — | 92 |
| 14 | 93.0 | — | 2.0 | — | — | — | — | 5.0 | 86 |
| 15 | 99.9 | — | 0.1 | — | — | — | — | — | 80 |
| 16 | 88.0 | — | 1.0 | 1.0 | 5.0 | — | 5.0 | — | 70 |
| 17 | 100.0 | — | — | — | — | — | — | — | 60 |
| 18 | — | 100.0 | — | — | — | — | — | — | 10 |
| 19 | 93.0 | — | 2.0 | — | 5.0[a] | — | — | — | 0[b] |
| 20 | 95.0 | — | — | — | 5.0 | — | — | — | 78 |
| 21 | 95.0 | — | — | — | — | — | 5.0 | — | 74 |

[a]5% by weight aqueous solution
[b]All of the plastic lenses were unacceptable due to the erosion on the surface.

(2) Two aqueous detergent baths each under ultrasonic waves and containing a 1% by weight aqueous solution of Mamaroyal, a mixture of anionic and nonionic surface active agents, manufactured by Lion Corp.

(3) Two rinse baths each under ultrasonic waves and in running city water.

(4) Two dehydration baths with isopropyl alcohol each under ultrasonic waves.

(5) Two finishing baths one as a dipping bath with Fron 113 (1,1,2-trichloro-1,2,2-trifluoroethane) and the other as a steaming bath.

The plastic lenses thus cleaned were provided with hard coating and then inspected for the appearance in respect of the surfance contamination. The percentage of the acceptable lenses was as shown in Table 1 for each organic detergent composition used in the above step (1). In Table 1, the chemical formulas and abridgements for the components of the liquid detergent compositions have the following meanings.

$CH_2Cl_2$: methylene chloride
$CCl_2$=CHCl: trichloroethylene
POEN: polyoxyethyleneglycol nonyl phenyl ether
DBS-Na: sodium dodecylbenzenesulfonate
TMAH(1): 1% by weight aqueous solution of tetramethyl ammonium hydroxide excepting Formulation No. 19 with a concentration of 5% by weight instead of 1%
CHOL(1): 1% by weight aqueous solution of choline
MeOH: methyl alcohol
i-PrOH: isopropyl alcohol

EXAMPLE 2

The glass molds used in the preparation of the plastic lenses in Example 1 were found each in a contaminated condition with similar contaminants as on the lenses and 100 pieces of the glass molds were put into a cleaning basket and subjected to the same cleaning procedure as in the cleaning of the plastic lenses in Example 1. In this case, the organic solvent-based detergent baths were filled with the liquid detergent composition prepared according to one of the formulations No. 22 to No. 43 indicated in Table 2 below in which the percentage of the acceptably cleaned glass molds is also given for each of the liquid detergent compositions. In Table 2, the chemical formulas and abridgements for the components of the detergent compositions have the same meaning as in Table 1 excepting the following.

TMAH(5): 5% by weight aqueous solution of tetramethyl ammonium hydroxide excepting Formulation No. 33 with a concentration of 10% by weight instead of 5% and Formulations Nos. 23, 24, 28 and 29 with methyl alcohol as the solvent instead of water
CHOL(5): 5% by weight aqueous solution of choline
$Na_2CO_3$: sodium carbonate

TABLE 2

| Experiment No. | Formulation of detergent composition, % by weight | | | | | | | | | % of acceptably cleaned glass molds |
|---|---|---|---|---|---|---|---|---|---|---|
| | $CH_2Cl_2$ | $CCl_2$=CHCl | POEN | DBS-Na | TMAH (5) | CHOL (5) | MeOH | i-PrOH | $Na_2CO_3$ | |
| 22 | 94.0 | — | 1.0 | — | 5.0 | — | — | — | — | 90 |
| 23 | 94.0 | — | 1.0 | — | 5.0[a] | — | — | — | — | 90 |
| 24 | 94.0 | — | — | 1.0 | 5.0[a] | — | — | — | — | 90 |
| 25 | 94.0 | — | 1.0 | — | — | 5.0 | — | — | — | 89 |
| 26 | 89.0 | — | 1.0 | — | 5.0 | — | — | — | — | 91 |
| 27 | 93.0 | — | 1.0 | 1.0 | 5.0 | — | — | — | — | 95 |
| 28 | 93.0 | — | 1.0 | 1.0 | 5.0[a] | — | — | — | — | 97 |
| 29 | 88.0 | — | 1.0 | 1.0 | 5.0[a] | — | 5.0 | — | — | 97 |

TABLE 2-continued

| Experiment No. | Formulation of detergent composition, % by weight | | | | | | | | | % of acceptably cleaned glass molds |
|---|---|---|---|---|---|---|---|---|---|---|
| | $CH_2Cl_2$ | $CCl_2{=}CHCl$ | POEN | DBS-Na | TMAH (5) | CHOL (5) | MeOH | i-PrOH | $Na_2CO_3$ | |
| 30 | 88.0 | — | 1.0 | 1.0 | 5.0 | — | — | 5.0 | — | 96 |
| 31 | 94.9 | — | 0.1 | — | 5.0 | — | — | — | — | 88 |
| 32 | 98.0 | — | 1.0 | — | 1.0 | — | — | — | — | 88 |
| 33 | 97.0 | — | 1.0 | — | 2.0[b] | — | — | — | — | 89 |
| 34 | 84.0 | — | 1.0 | — | 5.0 | — | 10.0 | — | — | 91 |
| 35 | — | 88.0 | 1.0 | 1.0 | 5.0 | — | 5.0 | — | — | 70[c] |
| 36 | 99.0 | — | 1.0 | — | — | — | — | — | — | 75[c] |
| 37 | 99.0 | — | — | 1.0 | — | — | — | — | — | 75[c] |
| 38 | 98.0 | — | 1.0 | 1.0 | — | — | — | — | — | 80[c] |
| 39 | 95.0 | — | — | — | 5.0 | — | — | — | — | 80[c] |
| 40 | 90.0 | — | — | — | 5.0 | — | 5.0 | — | — | 81[c] |
| 41 | 88.0 | — | 1.0 | 1.0 | — | — | 5.0 | — | 5.0 | 85[c] |
| 42 | 100.0 | — | — | — | — | — | — | — | — | 50[d] |
| 43 | — | 100.0 | — | — | — | — | — | — | — | 30[e] |

[a,b,c,d,e]See text.

The results of the cleaning treatment were quite satisfactory with the Formulations No. 22 to No. 34 while the resin smears, fingerprints and glove patterns slightly remained with Formulations No. 35 to No. 41, considerably remained with Formulation No. 42 and heavily remained with Formulation No. 43.

What is claimed is:

1. A liquid detergent composition which comprises:
(a) a halogenated hydrocarbon solvent;
(b) a surface active agent selected from the group consisting of anionic and non-ionic surface active agents in an amount from 0.01 to 10% by weight based on the overall amount of the detergent composition; and
(c) a quaternary ammonium hydroxide in an amount from 0.001 to 20% by weight based on the overall amount of the detergent composition.

2. The liquid detergent composition as claimed in claim 1 wherein the amount of the quaternary ammonium hydroxide is in the range from 0.001 to 0.1% by weight based on the overall amount of the detergent composition.

3. The liquid detergent composition as claimed in claim 1 wherein the amount of the quaternary ammonium hydroxide is in the range from 0.1 to 20% by weight based on the overall amount of the detergent composition.

4. The liquid detergent composition as claimed in claim 1 which further comprises a monohydric aliphatic saturated alcohol having from 1 to 6 carbon atoms in a molecule in an amount from 1 to 20% by weight based on the overall amount of the detergent composition.

5. The liquid detergent composition as claimed in claim 1 wherein the halogenated hydrocarbon solvent is methylene chloride or trichloroethylene.

6. The liquid detergent composition as claimed in claim 1 wherein the quaternary ammonium hydroxide is selected from the group consisting of tetramethyl ammonium hydroxide, tetraethyl ammonium hydroxide, choline and trimethyl benzyl ammonium hydroxide.

7. The liquid detergent composition as claimed in claim 4 wherein the monohydric aliphatic saturated alcohol is methyl alcohol.

* * * * *